United States Patent [19]

Hirschfelder et al.

[11] 4,010,095

[45] Mar. 1, 1977

[54] HYDRODYNAMIC METHOD FOR SEPARATION OF SOLID BODIES OR CRYSTALS

[75] Inventors: Joseph O. Hirschfelder; Edwin N. Lightfoot, both of Madison, Wis.; David W. Howard, Aiken, S.C.

[73] Assignee: Wisconsin Alumni Research Foundation, Madison, Wis.

[22] Filed: Aug. 1, 1974

[21] Appl. No.: 493,760

[52] U.S. Cl. ..... 209/132; 209/155; 209/751

[51] Int. Cl.[2] ..... B03B 5/00

[58] Field of Search ..... 209/1, 157, 451, 482, 209/198, 199, 132, 133, 155

[56] References Cited

UNITED STATES PATENTS

| | | | |
|---|---|---|---|
| 371,711 | 10/1887 | Robinson | 209/157 |
| 730,229 | 6/1903 | Burr | 209/157 X |
| 1,041,909 | 10/1912 | Trent | 209/451 |
| 1,400,389 | 12/1921 | Trottier | 209/155 |
| 1,811,408 | 6/1931 | Stebbins | 209/157 X |
| 1,893,578 | 1/1933 | Carey | 209/155 X |
| 2,198,296 | 4/1940 | Thoreau | 209/451 |
| 2,946,442 | 7/1960 | Mack | 209/482 |
| 3,334,743 | 8/1967 | Hiliyar-Russ | 209/451 X |
| 3,483,969 | 12/1969 | Rosenzweig | 209/1 |
| 3,599,791 | 8/1971 | Condolios | 209/157 |
| 3,788,465 | 1/1974 | Reimens | 209/1 |

OTHER PUBLICATIONS

Chem. Abst., 73, 1970, 112016y, 112017z.

*Primary Examiner*—Robert Halper
*Attorney, Agent, or Firm*—McDougall, Hersh & Scott

[57] ABSTRACT

A method for hydrodynamic separation of enantiomorphic crystals such as mono-clinic or tri-clinic crystals as well as other bodies, at least one of which does not possess a center of hydrodynamic resistance, wherein said bodies are caused to move in one direction through a fluid in face contact with a supporting surface whereby lateral separation between crystals or bodies are effected in response to a resultant perpendicular force acting on said crystals or bodies.

8 Claims, 6 Drawing Figures

FORCES AND TORQUES ON A PARTICLE IN A UNIFORM FLUID STREAM

SURFACE TRAJECTORIES OF PARTICLES FALLING IN A GRAVITATIONAL FIELD

TRAJECTORIES OF ASYMMETRIC TETRAHEDRONS

HYDRODYNAMIC METHOD FOR SEPARATION OF SOLID BODIES OR CRYSTALS

This invention relates to the separation of solid bodies and more particularly to the separation of crystal pairs, sometimes referred to as enantiomorphic crystals.

Various techniques have been developed commercially for the physical separation of solid bodies, such as by screening for separation as to size, by centrifugal separation based upon differences in specific gravity or weight, or by air separation based upon size and weight. Such physical techniques are not readily applied to the separation of solid bodies wherein such differences in size, specific gravity, or weight do not exist, especially when such bodies are in the form of crystal pairs, such as in the separation of D and L isomers.

It is an object of this invention to provide a method and means which makes use of hydrodynamic principles for the separation of solid bodies one from another, at least one of which does not possess a center of hydrodynamic resistance.

More specifically, it is an object of this invention to provide a method and means for hydrodynamically separating enantiomorphic crystals, such as monoclinic and tri-clinic crystals, from each other (in the resolution of optical isomers), or from less asymmetric impurities (as in purification of impure enantiomorph slurries).

These and other objects and advantages of this invention will hereinafter appear and for purposes of illustration, but not of limitation, embodiments of the invention are illustrated in the accompanying drawings, in which FIG. 1 is a simple diagram representative of hydrodynamic force vectors in terms of steady uniform flow past a rigidly mounted solid crystal capable of being hydrodynamically separated in accordance with the practice of this invention;

Briefly described, hydrodynamic separation of solid bodies, in accordance with the practice of this invention, utilizes the differences in horizontal velocity components on the solid bodies to cause separation in a horizontal direction during constrained gravitational fall through a viscous fluid (either liquid or gas).

Separation principles described below can be applied to the hydrodynamic separation of solid bodies which do not possess a center of hydrodynamic resistance, from each other or from more symmetric bodies, including such biologically important substances as enantiomorphic crystals of optical isomers. Concrete examples may be represented by solids having the shapes of simple mono-clinic and tri-clinic crystals, as well as any non-crystalline solids having the described symmetry.

Figure 1:
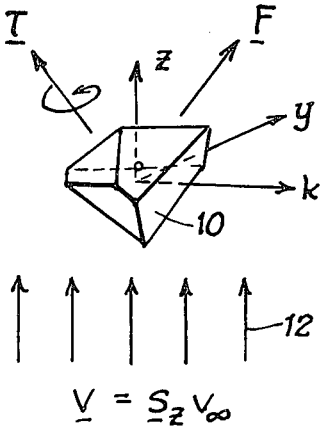

For the qualitative aspects of the hydrodynamic behavior relied upon to effect the separation of solid bodies, in accordance with the practice of this invention, reference is made to FIG. 1, illustrating the vectors existing during steady uniform flow past a rigidly mounted solid particle 10 of complex shape.

The fluid motion, represented by the arrows 12, will result in a viscous, or hydrodynamic force $\underline{F}$ tending to move the particle, and a torque $\underline{T}$ tending to twist it about the co-ordinate origin. In general, the force $\underline{F}$ and the torque $\underline{T}$ will not be aligned with the direction of fluid approach. This is indicated schematically in FIG. 1 and can be expressed mathematically in the equations:

$$\underline{F} = -D\mu[\underline{\underline{K}}\cdot\underline{v}] \quad (1)$$

$$\underline{T}_0 = -D^2\mu[\underline{\underline{C}}_0\cdot\underline{v}] \quad (2)$$

where $\underline{\underline{K}}$ and $\underline{\underline{C}}_0$ are dimensionless second-order tensors, dependent upon solid shape and Reynolds number $$Re = Dv\rho/\mu$$

where

D = any length characteristic of the body $\rho$ = fluid density $\mu$ = fluid viscosity In the limit of very small Reynolds numbers the translational tensor $\underline{\underline{K}}$ and the coupling tensor $\underline{\underline{C}}_0$ become functions only of shape, and, in the case of $\underline{\underline{C}}_0$, of the position chosen as the coordinate origin.

If the particle in question is rotating about the coordinate origin at an angular velocity $\omega$, then equations 1 and 2 can be written in the modified forms:

$$\underline{F} = -D\mu[\underline{\underline{K}}\cdot\underline{v}] - D^2\mu[\underline{\underline{C}}_0^{+}\cdot\underline{\omega}] \quad (1a)$$

$$\underline{T}_0 = -D^2\mu[\underline{\underline{C}}_0\cdot\underline{v}] - D^3\mu[\underline{\underline{\Omega}}_0\cdot\underline{\omega}] \quad (2a)$$

Here $\underline{\underline{C}}_0^{+}$ is the transpose $\underline{\underline{C}}_0$ but $\underline{\underline{\Omega}}_0$, the rotation dyadic, is additional.

A unique point R exists in any body for which the coupling tensor, here designated as $\underline{\underline{C}}_R$, is symmetric; this is the center of reaction. If $\underline{\underline{C}}_R = \mathbf{0}$ then R is also the center of hydrodynamic resistance. Bodies meeting this last condition will approach a steady motion without rotation when falling under the influence of gravity. This follows naturally from Equation 2*a*, with 0 taken at R, since torque will be zero in this situation. It will be the case for (perfectly formed) crystals of typical optically inactive species and will be very nearly true for such randomly formed materials as sand, gravel, etc.

On the other hand, many bodies of skewed shape, for example propellor-like bodies, do not possess a center of hydrodynamic resistance. These rotate as they fall in a gravitational field. Some, such as airplane propellors, fall so that the center of mass travels in a straight line. These are, however, rather special cases. More generally, such particles fall in a helical path. At steady state, this spiral can be described by Equations 1*a* and 2*a* by setting $\underline{T}_0$ equal to zero and $\underline{F}$ equal to the weight of the body in the surrounding fluid.

This is the normal situation for optically active crystals representative of the solid bodies capable of separation in accordance with the practice of this invention.

Figure 2:
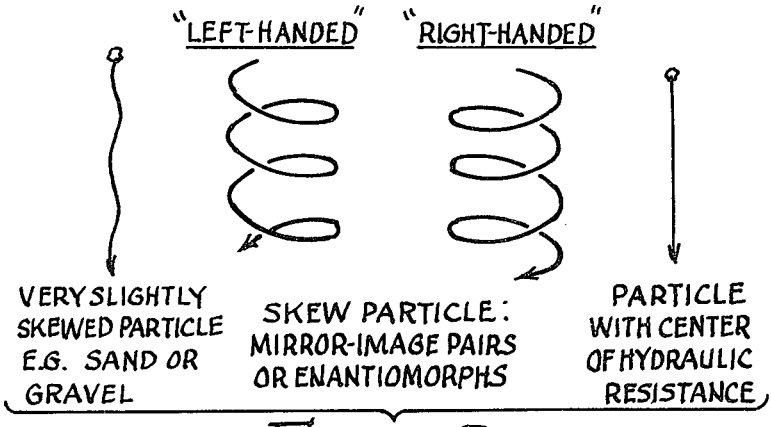
FIG. 2 is a diagrammatic illustration of sample trajectories in free gravitational fall of very slightly skewed particles, skewed particles, and particles with a center of hydrodynamic resistance.

Furthermore it is clear that opposite handed members of a pair (mirror images or enantiomorphs) will spiral in opposite directions, one left handed and one right handed, as illustrated in FIG. 2. Although one can take direct advantage of such spiraling motion, utilization of an asymmetric flow to cause a rectilinear displacement of opposite handed isomers from each other will generally be simpler and more effective.

The resultant horizontal force acting on the particle will tend to effect movement of the particle in the lateral direction, substantially perpendicular to fluid flow; the magnitude of the force will vary depending on a number of factors such as the type of fluid (density and/or viscosity), the rate of fluid flow, the weight of the particle, and the magnitude and orientation of the particle faces reacting to fluid engagement.

Corresponding force factors will develop to effect particle separation when the particles are free to move within a fluid, such as air or gas, or an inert liquid, or when both the particle and liquid are in relative movement, as will hereinafter be described.

Figure 3:
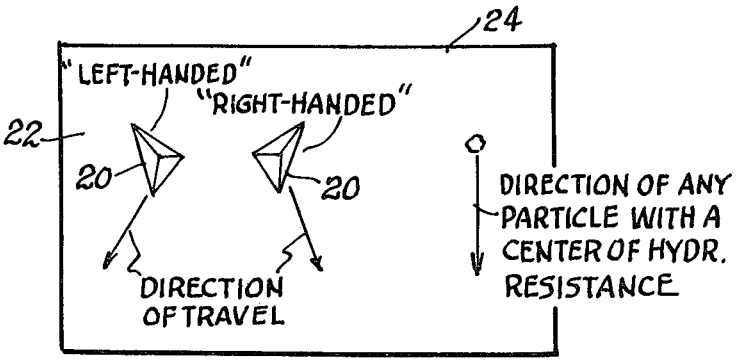
FIG. 3 is a top plan view of one means showing the trajectories of asymmetric tetrahedryl crystal pairs for separation in accordance with the practice of this invention.
Figure 4:
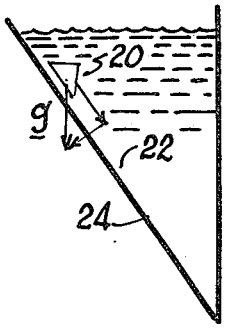
FIG. 4 is a side elevational view of the elements shown in FIG. 3.

One means by which the described technique can be practiced for the separation of solid bodies, in accordance with the practice of this invention, is illustrated in FIGS. 3 and 4 wherein the separation of particles 20, represented by asymmetric tetrahedrons, is achieved by sliding the particles downwardly, in response to gravitational force over the surface 22 of an inclined plane 24.

The angle of the surface can be varied over a fairly wide range. However, the surface should be at a sufficient angle from the horizontal to permit the particles to overcome the coefficient of friction and freely slide down the surface of the plane in response to gravitational force, but the angle should not be so steep that the particles can twist or roll about the line of its motion. In effect, the wall over which the particles slide should be able to exert sufficient torque to prevent an angular velocity $\underline{\omega}$ from developing. This torque prevents the particles from taking a spiral path. Instead, they move horizontally along the surface as they fall, as indicated in FIGS. 3 and 4, and as required by equation 1.

Thus, as illustrated in FIG. 3, two opposite-handed particles, such as D and L isomers of lysine, will tend to move relative to one another in the horizontal direction in response to their oppositely directed horizontal velocity components. In the same way, either will move apart from any particle with a center of hydrodynamic resistance since the latter will have no horizontal component at all, or either will move apart from any particle of different shape whereby it will have a horizontal component which differs so that the direction or magnitude of lateral displacement will not be the same. As a result, any two or more skew particles of different shape are subject to separation since the ratios of their horizontal to vertical velocity components will ordinarily be different with corresponding differences in horizontal displacement. It is this variation in trajectory with shape, during relative rectilinear movement with a fluid (gas or liquid), by which effective separation can be achieved of particles which have heretofore been difficult or impossible to separate, especially by simple mechanical means.

Figure 5:
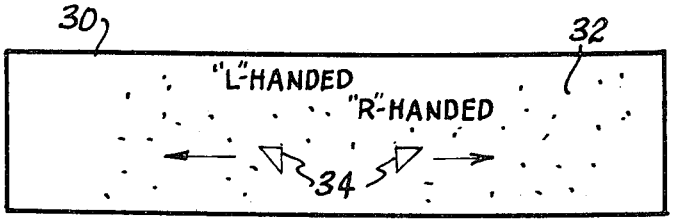
FIG. 5 is a schematic view of another means embodying the practice of this invention for the separation of crystal solids in the form of D and L isomers.
Figure 6:
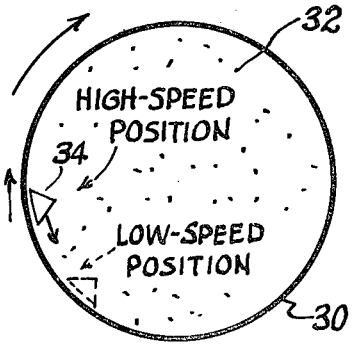
FIG. 6 is a sectional view across the axis of the means shown in FIG. 5.

Another adaptation, which provides the effect on an endless inclined plane, is illustrated in FIGS. 5 and 6 as a drum or cylinder 30, mounted for rotational movement about a horizontal axis. The cylinder is filled with a non-solvent fluid 32 in which the particles 34 to be separated are placed. The fluid should have a specific density which is different from that of the particles so that gravitational force will tend to cause the particles to settle either downward or upward within the liquid. Usually a less dense fluid is preferred, and subsequent discussion will be phrased for this situation. As the drum is rotated, the liquid tends to rotate as a solid body and carry the particles up the side by an amount which depends upon the rate of rotation of the cylinder. The rotation of the cylinder should be at a rate and direction to maintain the particles between the 6 and 9 o'clock positions and preferably between about the 7 and 8:55 o'clock positions, so that gravitational force will be effective to pull the particles in the downward direction and into engagement with the cylinder wall to keep the particles from twisting.

While the horizontal velocity component for particle separation is similar to that previously described for the inclined plane, there are a few differences in favor of the use of a continuously rotating cylinder for separation. For example, the vertical position of the particles can be held rather constant so that a cylinder of small diameter is essentially as effective as a drum of large diameter, insofar as the availability of time or duration for large or small horizontal displacement is concerned. On the other hand, in the use of a flat plate for separation, as previously described, the duration or time is limited by the length of the surface, whereby only incremental separation is achieved during each pass, thereby often to require multiple passes with increasing concentration of separated particles being provided during each pass.

Further, the ability of the wall to resist torque decreases towards zero as the particles rise to the level of the axis of rotation or the 9 o'clock position. It is possible, in the use of the liquid filled cylinder or drum, to keep the particles fairly close to this position so that velocity fluctuations can be used to provide frequent reorientation, and thus produce a statistical distribution of orientation.

From a practical standpoint, the described concepts for separation can be employed with any solid particles or crystals having at least four faces. Both the magnitude and direction of horizontal travel will vary somewhat with the face bearing against the confining surface. Thus, the particle or crystal should be reoriented frequently to obtain statistically uniform results. For best practice, the crystals should have one dominant face.

The trajectory of the particles will also somewhat depend upon the Reynolds number (Re). This makes it desirable, though not essential, to make use of particles or crystals of fairly uniform size distribution for separation. Flow asymmetry itself, however, exists at all Reynolds numbers so that, in principle, the process of separation is not Reynolds number dependent. Since turbulence reduces the ability to control, it is nevertheless desirable to limit the Reynolds number to less than about $10^2$. As a practical matter, low Reynolds numbers are preferred for at least two reasons:

1. In the Newton range (Re greater than $10^2$) inertial effects predominate and the effect of asymmetry is less.

2. In the creeping-flow range (Re less than 1) trajectory should be almost independent of Re, and hence of particle size. Since large crystals are expensive, it is desirable to avoid large Re in any event, so that no serious problems arise over this effect.

Having described the basic concepts of this invention and the means by which they can be employed to effect the desired particle and crystal separation, illustration will be made by way of examples to show migration of crystals in a rotating drum filled with an inert liquid.

EXAMPLE 1

A drum having an inside diameter of 4.945 inches and a length of 17.58 inches was filled with Isopar H (aliphatic hydrocarbon from Humble Oil & Refining Company) which had previously been dried by passage through a silica-gel column and saturated with dextro-rotary tartaric acid.

About one gram of natural (dextro-rotary) granular tartaric acid was introduced through an opening into one end of the drum whereafter the opening was sealed. The drum was tilted so that the crystals congregated at one end and the drum was then returned to a position with its axis horizontal. The drum was rotated at about 3 rpm so that the bulk of the crystals were continually sliding down the inner surface at an angle of about 45° to 60° from the lowest point. The drum was rotated clockwise as seen from the end at which the crystals were originally congregated.

Within about 1½ hours, the bulk of the crystals had migrated to the other end of the drum. A small fraction, presumably the less perfect crystals, were distributed more or less at random along the length of the drum.

The direction of rotation of the drum was then changed repeatedly and each time the direction of crystal migration reversed. In all instances, the direction of the axial motion is the same as vector of cross product of the gravitational vector with the velocity of the wall down which the crystals are sliding, as represented by the following equation:

$$\underset{\sim}{\delta} = [\underset{\sim}{g} \times \underset{\sim}{v}] / [\underset{\sim}{g} \times \underset{\sim}{v}]$$

where $\underset{\sim}{\delta}$ = direction of the migration
$\underset{\sim}{g}$ = gravity acceleration
$\underset{\sim}{v}$ = velocity of the wall in the immediate neighborhood of the sliding crystals

EXAMPLE 2

Natural tartaric emetic crystals in the form of double pyramids having a length of the order of one-fourth inch were treated generally as described in Example 1. Measurements were made and recorded as normalized approximate first moments as a function of time, in which the moments are defined as $$M_1 = \frac{1}{N} \sum_{i=0}^{N} \underset{\sim}{x}_i \cdot \underset{\sim}{\delta}_n \quad (i = \text{individual crystals})$$

$$\underset{\sim}{\delta}_n = +\underset{\sim}{\delta}_z \quad \text{for right-hand rotation}$$

$$-\underset{\sim}{\delta}_z \quad \text{for left-hand rotation}$$

$\underset{\sim}{x}_i$ = distance of $i$th crystal to right of drum (in $z$-direction).

Distances are only approximate (two twelfths of length with distances to middle of twelfth). Maximum separations possible are then $\pm(5.5/12) = \pm 0.46$.

First-moment calculations were made for four runs at a speed setting of 5 (one in each direction for crystals initially at each end). The results are summarized below in tabular form. The average first moments after 200 rotations were:

| Direction of Rotation | Initial Position of Crystals | Final Value of Moment |
|---|---|---|
| Left hand | Left end | + 0.078 |
| Left hand | Right end | + 0.225 |
| Right hand | Left end | + 0.065 |
| Right hand | Right end | − 0.198 |
| | Average | + 0.045 |

These are typical results for tartar ametic crystals in this type of equipment in that the moment is normally positive but that occasional negative values are observed.

Since non-skew bodies give moments of zero, and opposite handed crystals give moments of opposite sign, appreciable separations can be obtained in this device.

However, both the low values of the moment, and the occasional reversal of sign result primarily from entrapment of crystals at the end of the drum as a result of secondary flows. Therefore, a design modification is in order, two possibilities of which will hereinafter be described:

1. long cylinders so that crystals do not reach the ends,
2. conical ends so that gravitational forces tend to prevent undue accumulation.

The effect of the first of these modifications is described in the third example.

EXAMPLE 3

Eighteen carefully prepared crystals of 1-lysine hydrochloride between one and three millimeters in diameter were introduced to the center of a drum of about 2½ inches in diameter and 18 inches in length. The drum was marked in quadrants numbered from one (left end) to four (right end). Crystal distributions were measured after five minutes of rotation. Typical results are:

| | Number of crystals in quadrant | | | |
|---|---|---|---|---|
| Rotation | 1 | 2 | 3 | 4 |
| Left | 3 | 1 | 0 | 14 |
| Right | 13 | 0 | 1 | 4 |
| Left | 2 | 0 | 0 | 16 |
| Right | 13 | 1 | 1 | 3 |

In 23 of 25 runs, crystals concentrated in the right end of the cylinder for left rotation or at the left end for right rotation. Normally the degree of separation was high, as indicated in the table, and the bulk of anomalous crystals appeared to be captured by secondary flows, i.e. congregated at the extreme ends of the tube. Furthermore, in the two anomalous runs, secondary flow capture appeared unusually strong.

Resolution of lysine hydrochloride enantiomorphic crystals is thus feasible. Lower specificity obtained with larger concentrations of less well formed d-crystals suggests that total solids concentration should be kept low for maximum separability and that separation is more easily obtained with well formed crystals.

We claim:

1. A method of employing hydrodynamic principles for separating solid bodies, at least one of which does not possess a center of hydrodynamic resistance and which have a number of faces, subjecting said solid bodies, while immersed in a viscous fluid of different specific gravity than that of the solid bodies, to gravitationally influence relative linear movement between said bodies and fluid, supporting said bodies on a non-horizontal surface for maintaining said bodies in a common face relation with respect to each other and to said surface in such a manner that they do not twist, during such relative movement establishing in response to such relative movement between the solid bodies and fluid a resultant force that acts on said bodies in the same plane but in a direction perpendicular to the direction of relative linear movement and that causes relative movement between said bodies in the same plane but in the perpendicular direction to cause separation.

2. The method as claimed in claim 1 in which said solid bodies have at least four faces.

3. The method as claimed in claim 1 in which said solid bodies are skewed bodies.

4. The method as claimed in claim 1 in which said bodies are enantiomorphic crystals of optical isomers.

5. The method as claimed in claim 1 in which the step of maintaining said bodies in face relation comprises supporting said bodies on a flat surface and maintaining said surface at an angle sufficient to overcome the coefficient of friction between the contacting face of the body and said surface, whereby the bodies slide freely down the surface.

6. The method as claimed in claim 5 which includes a step of flowing a liquid over the surface in the direction of said relative linear movement between the bodies and fluid-has been added after during movement of the bodies thereover.

7. The method as claimed in claim 1 in which said bodies are maintained in face relation during relative movement by a cylindrical member mounted for rotation movement about a horizontal axis, rotating said cylindrical member with the bodies therein at a rate to maintain said bodies gravitationally in contact with the interior surface of said cylindrical member between the 6 o'clock and 9 o'clock positions.

8. The method as claimed in claim 7 in which the cylindrical member contains a fluid having a density less than that of the bodies whereby the bodies remain in contact with the interior surface of the cylindrical member in response to gravitational force.

* * * * *